United States Patent [19]

Plotkin

[11] Patent Number: 4,967,491

[45] Date of Patent: Nov. 6, 1990

[54] DISPOSABLE, COLLAPSABLE OVERSHOE

[76] Inventor: Howard Plotkin, 1020 Cardinal La., Cherry Hill, N.J. 08003

[21] Appl. No.: 347,254

[22] Filed: May 4, 1989

[51] Int. Cl.[5] ..... A43B 3/16

[52] U.S. Cl. ..... 36/7.1 R; 36/7.400

[58] Field of Search ..... 36/7.1 R, 7.2, 9 R, 36/7.4

[56] References Cited

U.S. PATENT DOCUMENTS

| | | | |
|---|---|---|---|
| 146,496 | 1/1874 | Watkinson | 36/7.3 |
| 227,811 | 5/1880 | Miller | 36/7.3 |
| 1,258,024 | 3/1918 | Laybourn | 36/9 R |
| 1,604,954 | 11/1926 | Artz | 36/7.1 R |
| 1,644,217 | 10/1927 | Wreford | 36/7.1 R |
| 2,265,089 | 12/1941 | Turbin | 36/9 R |
| 2,643,468 | 6/1953 | Gottschalk | 36/7.4 |
| 2,721,399 | 10/1955 | Emmer | 36/7.1 R |
| 2,735,195 | 2/1956 | Eaton | 36/9 R |
| 2,966,749 | 1/1961 | Loewengart et al. | 36/7.3 |
| 3,141,247 | 7/1964 | Mackay | 36/7.1 R |
| 3,634,954 | 1/1972 | Larsen et al. | 36/7.3 |
| 4,194,308 | 3/1980 | Karlsson | 36/9 R |
| 4,825,564 | 5/1989 | Sorce | 36/9 R X |

FOREIGN PATENT DOCUMENTS

| | | | |
|---|---|---|---|
| 244109 | 2/1912 | Fed. Rep. of Germany | 36/7.1 R |
| 59180 | 5/1954 | France | 36/9 |
| 511821 | 8/1939 | United Kingdom | 36/9 |

*Primary Examiner*—Paul T. Sewell
*Assistant Examiner*—A. Meyers
*Attorney, Agent, or Firm*—T. M. Gernstein

[57] ABSTRACT

A disposable overshoe includes a plurality of foldlines that are strategically placed and oriented to permit the overshoe to be easily collapsed into a container that is small and compact. The overshoe can include a shaft portion and can include a heel base section to accommodate high heel shoes, and can include an abbreviated shaft portion.

1 Claim, 3 Drawing Sheets

DISPOSABLE, COLLAPSABLE OVERSHOE

TECHNICAL FIELD OF THE INVENTION

The present invention relates to the general art of apparel, and to the particular field of foot coverings. Specifically, the present invention relates to disposable overshoes.

BACKGROUND OF THE INVENTION

The demand for shoe coverings, such as overshoes and the like, has generated many designs for boots and the like.

Still further, with the advent of clean room environments, medical environments and the like requiring ultra clean conditions, there has been a further demand for disposable shoe coverings since such environments permit but a single use of such shoe coverings. This demand, also, has generated a plethora of designs, see, for example, the designs disclosed in U.S. Pat. Nos. 3,634,954, 4,616,428 and 4,616,429, among others.

However, while successful in certain applications, these proposed designs have met with only limited commercial acceptance outside of the industrial environments such as mentioned above. There are several reasons for this problem. Among such reasons is the bulkiness of such designs when they are being stored before use. In the industrial environment, for example, storage of such articles is not a great problem; however, as a consumer item which will be carried on the person, perhaps in a briefcase or in a purse, or the like, storage does present a problem. Articles such as the just-mentioned items which are intended for use in an industrial-type environment with ample storage facilities simply do not account for the problems encountered by a user tying to store many items in addition to the disposable overshoe in a small carrying case. Accordingly, such items are not designed with such use in mind, and simply are too bulky to be stored in such a manner.

Many overshoes are simply stuffed into a carrying case for storage. This does not make for efficient use of space, since the water repellant nature of the material of such articles often is not amenable to such collapsing due to its memory characteristics. Therefore, this type of overshoe has problems of the above-mentioned type, even if it were considered as being disposable.

Therefore, there is a need for a disposable overshoe that is amenable to efficient end easy storage in a small package.

OBJECTS OF THE INVENTION

It is a main object of the present invention to provide a disposable overshoe that is easily and efficiently stored.

It is another object of the present invention to provide a disposable overshoe that is easily collapsed for compact storage.

It is another object of the present invention to provide a disposable overshoe which is conveniently storable in a compact package.

SUMMARY OF THE INVENTION

These, and other, objects are achieved by a disposable overshoe that has means for permitting easy folding thereof into a compact size. This means includes strategically located and configured foldlines which co-operate to permit the overshoe to be folded over itself into a small, compact shape for insertion into a small package for storage.

The foldlines are areas of weakening, such as scorelines, or the like to overcome the tendency of the material to regain its unfolded configuration due to its memory, yet do not unduly weaken the overshoe so that it can still function as a reliable shoe covering that may be subject to harsh conditions.

DETAILED DESCRIPTION OF THE PREFERRED EMBODIMENT OF THE INVENTION

Figure 1:
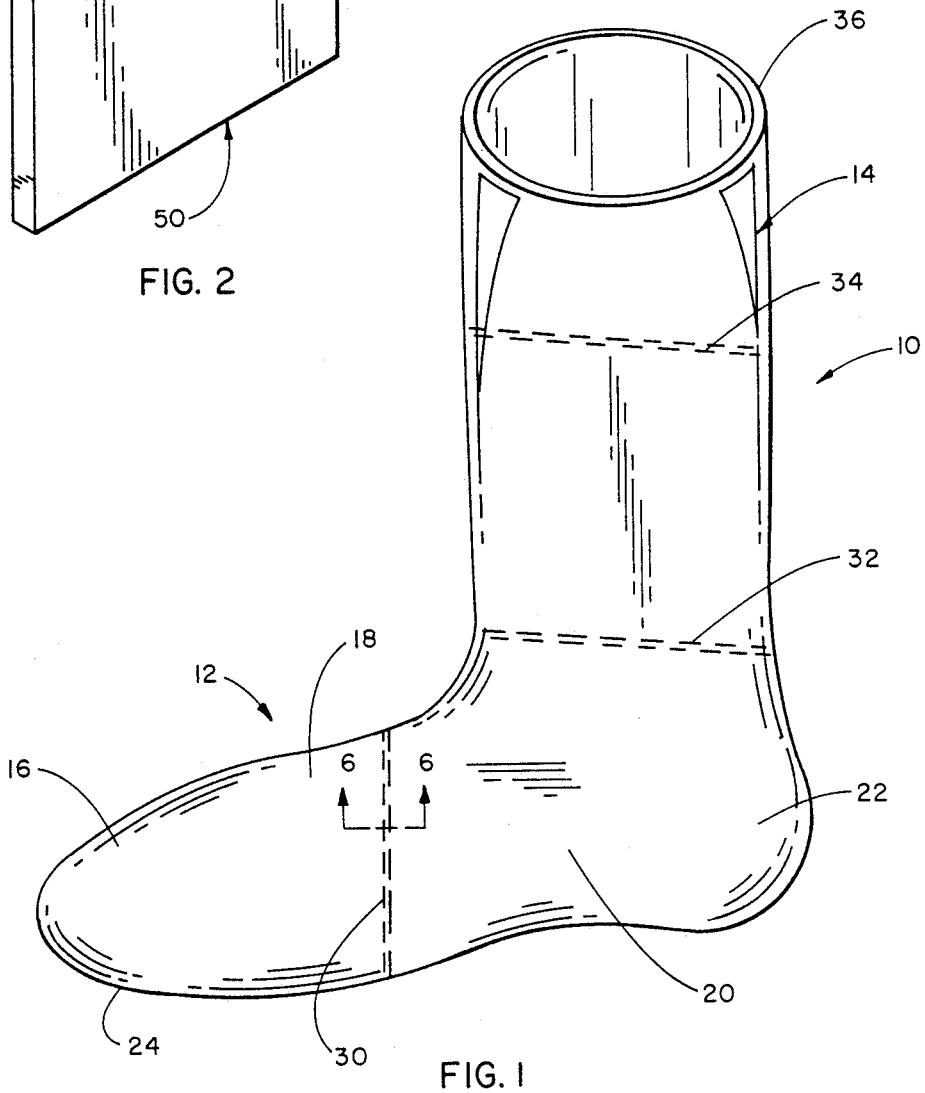
FIG. 1 is a perspective view of one form of the overshoe embodying the present invention.

Shown in FIG. 1 is an overshoe 10 which is disposable, which is easily collapsed for storage, and once collapsed will not be unduly biased back towards an unfolded configuration by material memory. The overshoe 10 is monolithic and is formed of water-repellant material, such as a rubber or plastic material, or the like. The overshoe 10 includes a foot portion 12 and a shaft portion 14 for completely encasing a wearer's shoes.

The foot portion 12 includes a toe section 16, a vamp section 18, a quarter section 20 and a heel section 22 as well as an outsole section 24. The outsole section can be formed to provide traction on ice or other slippery substances by being suitably roughened during manufacture. The foot portion has a centerline axis that extends along the central axis of a wearer's foot when the overshoe is being worn.

To facilitate collapsing of the overshoe 10, there are provided a plurality of foldlines thereon. The foldlines include a first foldline 30 on the vamp section and on the outsole section. This foldline circumnavigates the vamp section, that is, it extends completely around such section, and is slightly angled with respect to the centerline axis of the foot portion so that the toe section can be folded directly upon the heel portion for storage of the overshoe.

A second foldline 32 is located on the shaft portion immediately above the foot portion, circumnavigates the shaft portion, and is oriented approximately parallel to the centerline axis of the foot portion so that foot portion can be folded upwards onto the shaft portion after the toe section has been folded over the heel portion as above discussed.

A third foldline 34 is located on the shaft near the upper rim 36 of that shaft, and circumnavigates the shaft portion. The foldline 34 is essentially parallel to the foldline 32. Folding of the overshoe is effected by simply folding the toe portion 16 over the vamp portion at the foldline 30, folding the doubled article upward onto the shaft at the foldline 32, and then folding the shaft again at the foldline 34 to place the upper portion of the shaft on top of the folded elements. The thus folded overshoe is then easily unfolded by simply grasping the rim 36, and snapping the overshoe downwardly.

Figure 2:
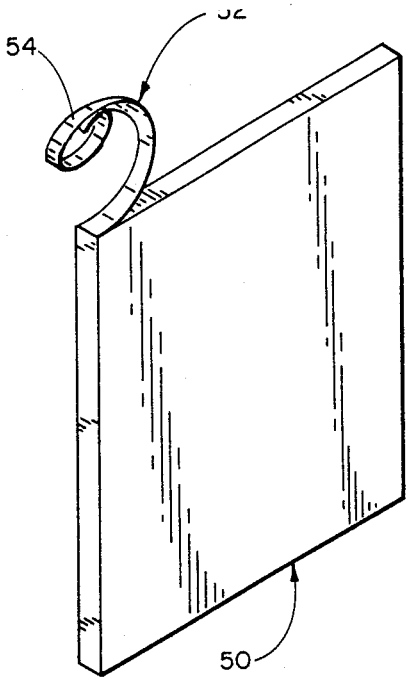
FIG. 2 is a perspective view of a package used to store the overshoe of the present invention.

The folded overshoe is placed into a storage container 50, best shown in FIG. 2. This storage container is hollow to contain the overshoe, and includes a handle 52 which includes a loop 54 which is sized and configured to attach to an umbrella or the like so that the stored overshoes can be located at a convenient location that is always used in the event of a storm.

Figure 3:
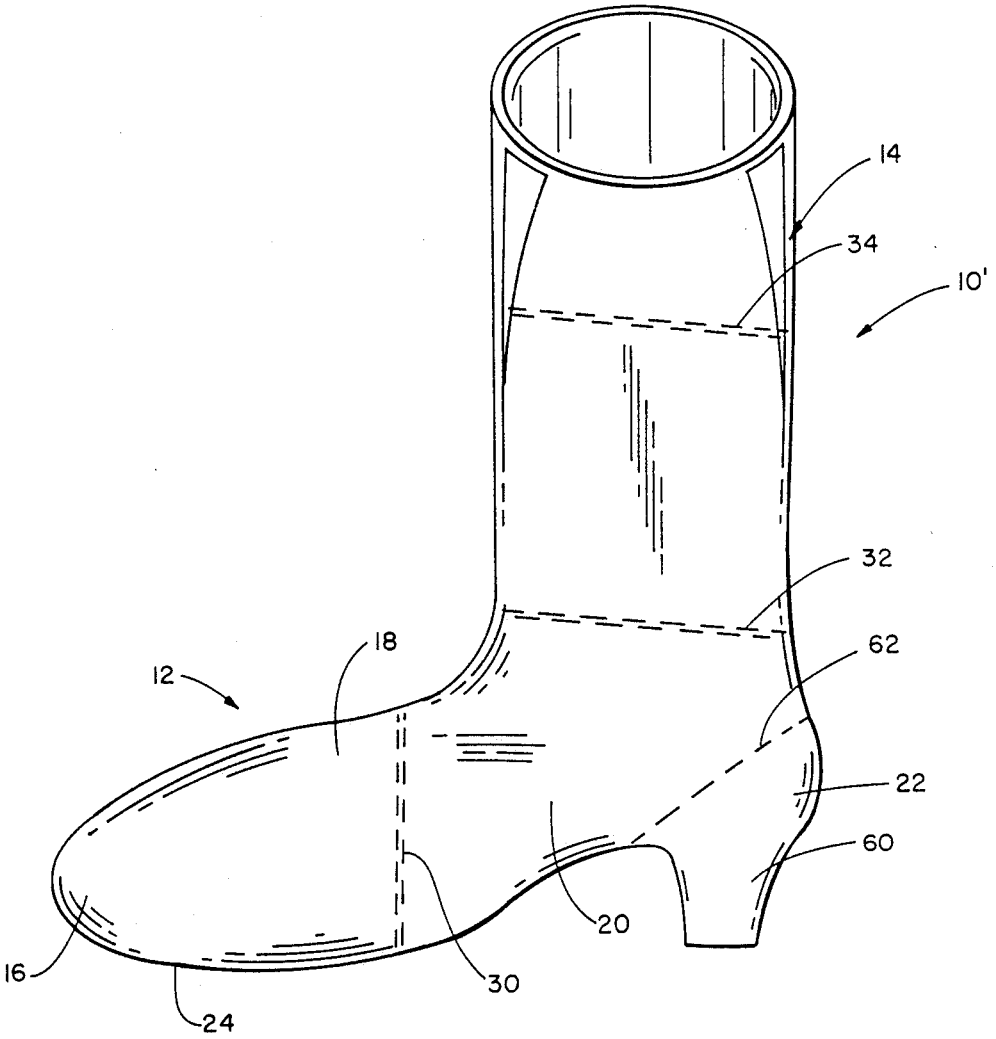
FIG. 3 is a perspective view of another form of the overshoe of the present invention.

A second form of the overshoe of the present invention is shown in FIG. 3 as overshoe 10' and is identical to the overshoe 10, with the exception that the overshoe 10' includes a heel base 60 which accommodates high heels, and a fourth foldline 62 is included on the heel portion. The foldline 62 circumnavigates the shaft and is angled with respect to the foldline 30 so that the heel base can be folded upwards against the heel portion of the overshoe 10'.

Folding of the overshoe 10' is similar to the folding of the overshoe 10, in that the toe portion is first folded over at the foldline 30 on top of the heel portion, and the heel base is then folded upwards at the foldline 62 on top of these folded sections. The thus folded elements are then folded upwards at the foldline 32 against the shaft, and the top of the shaft is then folded downwards at the foldline 34 to form the folded and collapsed overshoe that is then placed in an appropriate container.

Figure 4:
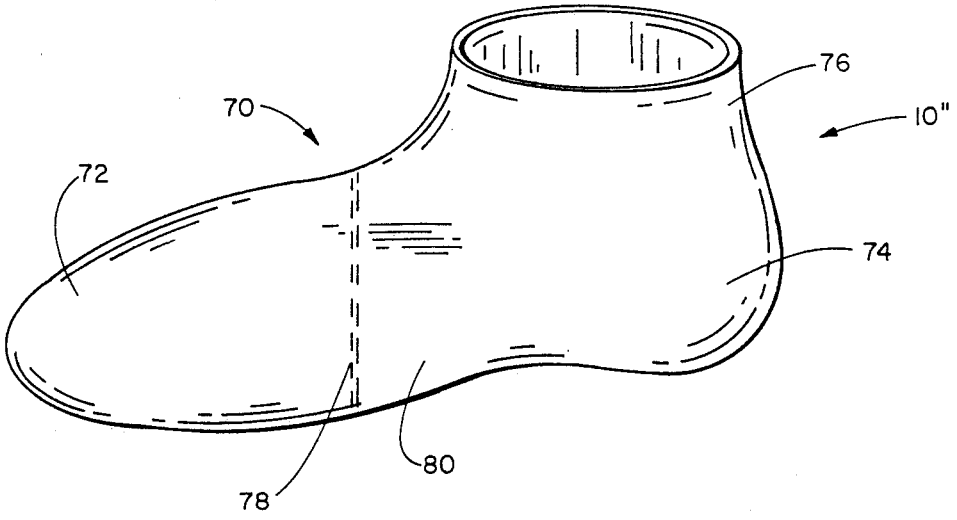
FIG. 4 is a perspective view of another form of the overshoe of the present invention.
Figure 5:
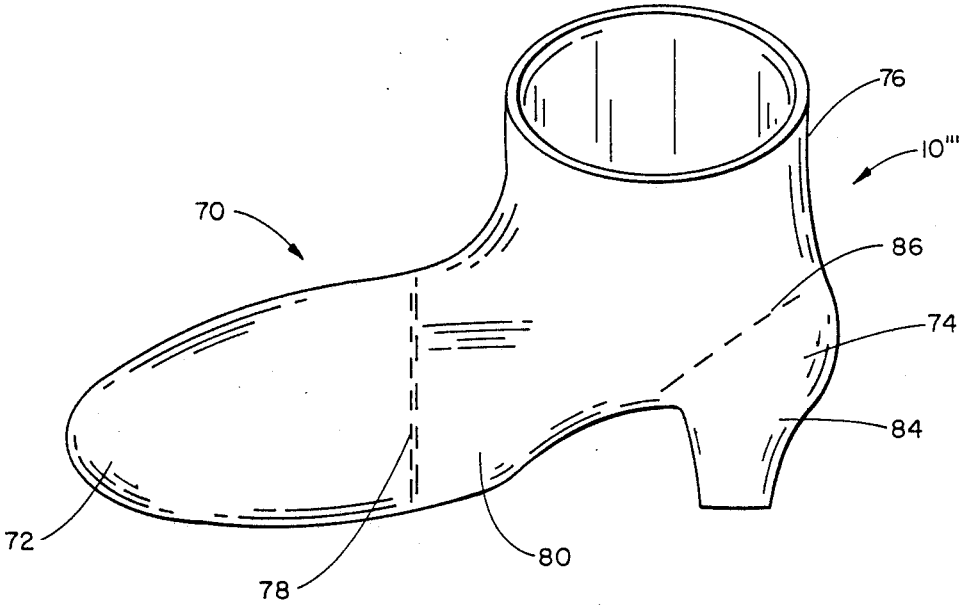
FIG. 5 is a perspective view of another form of the overshoe of the present invention.

Still further forms of the overshoe are shown in FIGS. 4 and 5, and attention is now adverted thereto. The overshoe 10'' is shown in FIG. 4, and includes a foot section 70 having a toe section 72, a heel section 74, and a shaft 76 that is abbreviated with respect to the shaft 14 as can be seen by comparing FIGS. 1 and 4. The overshoe 10'' also includes a foldline 78 that circumnavigates the vamp portion 80 and is used to fold the toe portion onto the heel portion. The thus folded overshoe 10'' is easily fit into a small container.

The overshoe 10''' shown in FIG. 5 is similar to the overshoe 10'', except that it includes a heel base 84 and a foldline 86 which is used to fold the heel base on top of the foot portion of the overshoe 10'''.

The foldlines are formed by scoring the material of the overshoe in an appropriate manner to weaken the material in order to permit an overshoe formed of otherwise resilient material having a memory to be easily folded, and once folded, to remain folded without having material memory tending to bias the folded overshoe back into an unfolded configuration.

Figure 6:
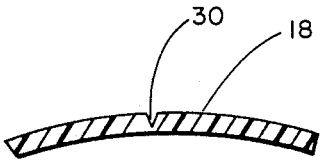
FIG. 6 is a view taken along line 6—6 of FIG. 1 to show the shape and depth of a scoreline which forms a foldline of the overshoe of the present invention.

In the preferred embodiment, the foldlines are formed by scoring, and such scoring is shown in FIG. 6. The scoring is shown in connection with foldline 30, but is applicable to the other foldlines as well. The scoring is effected to define a V-shaped slot that has a depth of just slightly more than half the thickness of the material. In this manner, the material is weakened sufficiently to permit folding, but not so much as to unduly weaken the material that is being used as a shoe covering and will be subject to wear and severe conditions. Accordingly, the scoreline must have a dept that accounts for both of these competing considerations. It has been found that the V-shaped scoreline having the depth of just slightly greater than half of the thickness of the material meets and satisfies such competing considerations. The V shape of the scoreline also contributes to the ease with which the item is folded.

In one embodiment of the overshoe, the scoreline 30 does not circumnavigate the foot portion, but only extends about the vamp section so that the outsole is not scored.

It is understood that while certain forms of the present invention have been illustrated and described herein, it is not to be limited to the specific forms or arrangements of parts described and shown.

I claim:

1. A disposable overshoe comprising:

a monolithic body of resilient water-repellent material, said body having an outer surface and an inner surface and a thickness defined between said outer surface and said inner surface, said body including (1) a foot portion which includes (a) a toe section, (b) a vamp section, said vamp section having a thickness, (c) a quarter section, (d) a heel section having a height, (e) an outsole, and (f) a centerline axis which extends from said toe section to said heel section, (2) a shaft portion attached to said foot portion, said shaft portion extending upward from said foot portion for a distance substantially greater than said heel section height, (3) a first foldline on said vamp section, said first foldline (a) being defined by a V-shaped groove defined in said vamp section, said groove having a depth which is greater than one-half of the thickness of the vamp section, (b) extending completely around the circumference of said vamp section and said outsole to circumnavigate said body at said vamp section to permit said toe section to be completely folded on top of said vamp section, and (c) being oriented at a non-right angle with respect to the centerline axis of said foot portion, (4) a second foldline on said shaft portion adjacent to said foot portion, said second foldline (a) being defined by a V-shaped groove defined in said shaft section, said groove having a depth which is greater than one-half of the thickness of the shaft section, (b) extending completely around the circumference of said shaft portion to circumnavigate said body at said shaft portion to permit said foot portion to be folded on top of said shaft portion, and (c) being oriented to be parallel to said foot portion centerline axis, and (5) a third foldline on said shaft portion, said third foldline (a) being defined by a V-shaped groove defined in said shaft section, said groove having a depth which is greater than one-half of the thickness of the shaft section, (b) extending completely around the circumference of said shaft portion to circumnavigate said body at said shaft portion, said second foldline being positioned between said third foldline and said foot portion, and (c) being oriented to be parallel to said second foldline.

* * * * *